US005566824A

United States Patent [19]

Tack et al.

[11] Patent Number: 5,566,824

[45] Date of Patent: Oct. 22, 1996

[54] PACKAGING ASSEMBLY WITH IMPROVED STACKABILITY

[75] Inventors: Joris G. J. Tack, Keerbergen; Christian D. Verhelle, Mechling, both of Belgium

[73] Assignee: The Procter & Gamble Company, Cincinnati, Ohio

[21] Appl. No.: 491,967

[22] PCT Filed: Jan. 19, 1994

[86] PCT No.: PCT/US94/00745

§ 371 Date: Jul. 18, 1995

§ 102(e) Date: Jul. 18, 1995

[87] PCT Pub. No.: WO94/16955

PCT Pub. Date: Aug. 4, 1994

[30] Foreign Application Priority Data

Jan. 20, 1993 [EP] European Pat. Off. ..... 93870007

[51] Int. Cl.[6] ..... B65D 81/18; B65D 21/00

[52] U.S. Cl. ..... 206/213.1; 206/526

[58] Field of Search ..... 206/427–435, 206/497, 503, 526, 213.1; 53/428, 449, 450, 461; 229/103.2, 190

[56] References Cited

U.S. PATENT DOCUMENTS

| | | | |
|---|---|---|---|
| 3,694,995 | 10/1972 | McKinney | 53/442 |
| 3,817,018 | 6/1974 | Vickers | 53/32 |
| 3,833,116 | 9/1974 | Howe | 206/431 |
| 4,793,490 | 12/1988 | Evert | 206/497 |
| 5,004,104 | 4/1991 | Saulas | 206/526 |

FOREIGN PATENT DOCUMENTS

| | | | |
|---|---|---|---|
| 2635722 | 2/1978 | Germany . | |
| 996849 | 6/1965 | United Kingdom | 206/526 |
| 1206053 | 9/1970 | United Kingdom | 206/526 |
| 2124597 | 2/1984 | United Kingdom . | |
| WO9208610 | 5/1992 | WIPO . | |

*Primary Examiner*—Jimmy G. Foster
*Attorney, Agent, or Firm*—Ronald W. Kock

[57] ABSTRACT

The present invention relates to packaging assemblies with improved stackability. The packaging assembly comprises multiple inner containers which are combined by a tight fitting outer case into the packaging assembly. The inner containers are flexible and contain a fluid and a gas filled head space. By providing the inner containers with an inside pressure above the ambient pressure, the stackability of the otherwise non or at least unreliably stackable packaging assembly is substantially improved.

3 Claims, 2 Drawing Sheets

PACKAGING ASSEMBLY WITH IMPROVED STACKABILITY

FIELD OF THE INVENTION

The present invention relates to packaging assemblies with improved stackability. The packaging assembly comprises multiple inner containers which are combined by a tight fitting outer case into the packaging assembly. The inner containers are flexible and contain a fluid and a gas filled head space. By providing the inner containers with an inside pressure above the ambient pressure, the stackability of the otherwise non or at least unreliably stackable packaging assembly is substantially improved.

BACKGROUND OF THE INVENTION

Flexible packages for fluids are widely used in the foods and household chemical industry. For example laminated cartons for milk, beverages, fluid detergents, household cleaners or fabric softeners, motor oil or cosmetics which often are of brick type (rectangular) or of the gable top type (rectangular but with gable top)are familiar and much used packages for fluids. They are appreciated for their light weight and a low raw material consumption, good handlebility by the user of the fluid and simple processing requirements for those commercializing fluids in such packages.

The stability of such a flexible container typically must satisfy the highest requirements of the different usage situations of the package. The principle three usage situations are that at the manufacturer where the package is assembled and filled with fluid, the storage and distribution conditions (including transport and store handling) and finally at the user of the fluid. Out of these the storage and distribution conditions pose the highest requirements on a flexible container, in particular sufficient stackability is critical in depot storage and truck transport.

In order to limit the material consumption but still to withstand essentially all storage and distribution requirements while improving at the same time the handling during storage and in the distribution system flexible containers are often combined into a packaging assembly. The packaging assembly can be formed by stretch or shrink wrapping several flexible containers together,.which improves foremost the handling of the packaging assembly and not so much the stability. Also the packaging assembly can be formed by a high strength outer case which provides the required strength to support stacking of several packaging assemblies and makes handling of the number of inner containers which are combined in the packaging assembly easy.

The before mentioned advantages of the flexible container are however diminished when using such a high strength outer case. Therefore an objective of the present invention is to provide a packaging assembly having flexible inner containers and only requiring a low strength outer case. Alternative the objective of the present invention is to improve the stackability of a packaging assembly comprising inner containers combined by an outer case.

Other objectives satisfied or improved by the present invention are reduced material consumption for the inner containers and the outer case; allowing to reduce or eliminate additional packaging support or protection items for the packaging assembly (corner posts, cardboard layers, stretch or shrink wrap); better appearance of the individual packaging assembly and of larger combinations of packaging assemblies. The improved packaging assembly further does not restrict the use as a display case.

It is yet another independent objective of the present invention to provide a process allowing the manufacture of the improved packaging assembly. These and other objectives will become more apparent in the following description of the invention.

BRIEF DESCRIPTION OF THE INVENTION

According to the invention there is provided a packaging assembly of multiple identical flexible inner containers for fluids combined in a tight fitting outer case of generally rectangular shape. The flexible inner containers comprise a head space filled with gas above the fluids. The packaging assembly allows improved vertical stacking by an inside pressure in the flexible inner containers above the ambient pressure.

The characteristics of the preferred executions of the inventions are those found in the dependent claims.

According to the processing aspect of the invention to manufacture packaging assembly according to the invention, the following steps have to be conducted a) providing a flat carton blank for forming a lower tray part which constitutes the bottom and the side walls of the outer case;

b) providing inner containers of increased inside pressure and placing them on the flat carton blank in the bottom area;

c) folding up the side walls of the carton blank to form the lower tray part tightly around the inner containers and joining the side walls along their vertical edges to each other;

d) placing a lid on top of the inner containers and joining the lid to the lower tray part, preferably along two opposite horizontal upper edges of the lower tray part at overlapping flaps which may be integral to the lid or to the lower tray part.

DETAILED DESCRIPTION OF THE INVENTION

Figure 1:
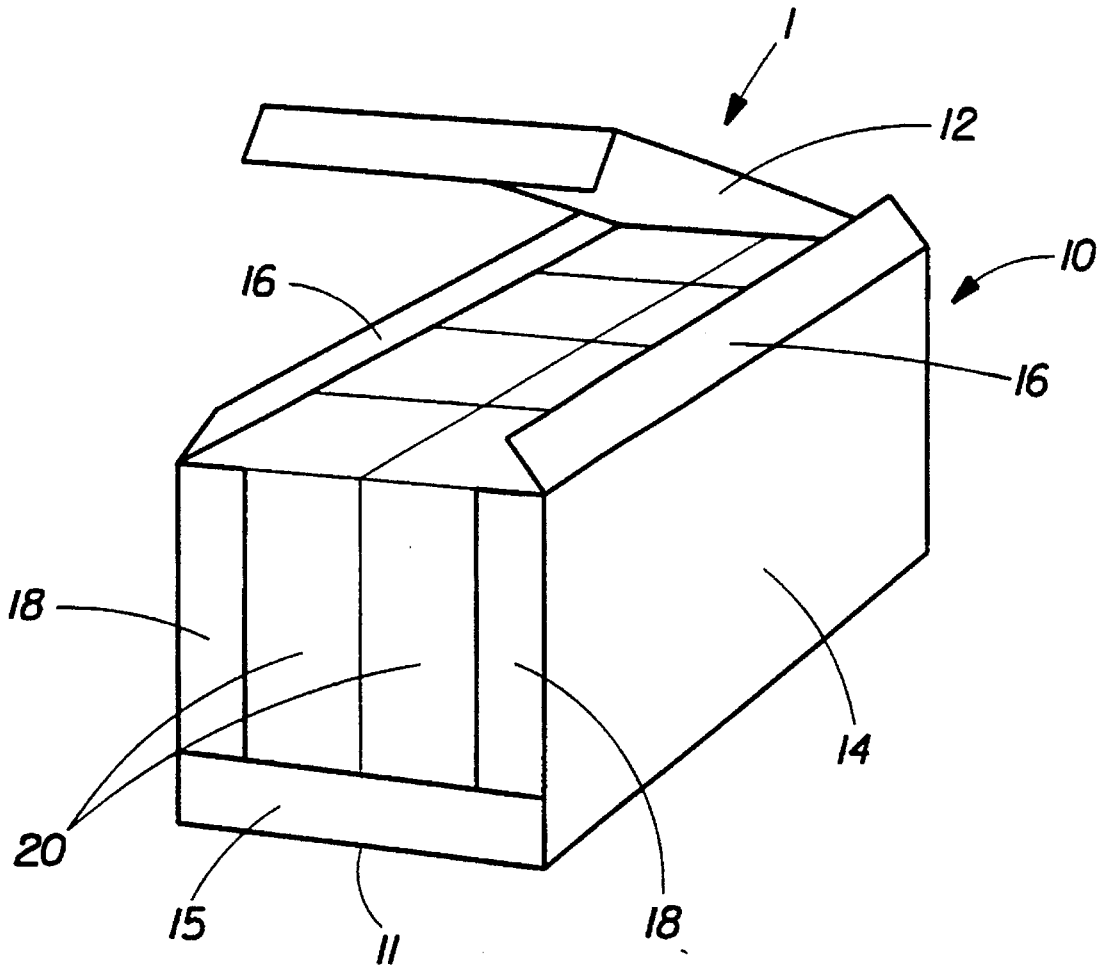
FIG. 1 shows a preferred execution of the packaging assembly according to the invention with inner containers and an outer case folded around the inner containers.

The multiple inner containers of the packaging assembly according to the present invention are flexible. Flexible in this context refers to containers which would start bulging and possibly even collapse when being stacked on top of each other.

Such containers are well known in the art and are typically made of laminate material for which the layers of the laminate are selected from paper, cardboard, aluminum foil and polymeric materials. The order in which these materials are laminated together strongly depends on the fluid to be filled into these inner containers.

In particular inner containers for liquids which easily oxidize and thereby deteriorate preferably have one gas tight layer for example of aluminum foil. Many food products like fruit juice beverages are therefore preferably packed into inner containers having a laminate structure which includes an oxygen barrier like aluminum foil. Other products such as household chemicals like fabric softeners, liquid detergents or liquid household cleaners do not require such additional precaution and can be packed into a simple laminate of polymeric materials and paper or cardboard. Those skilled in the art will easily be able to define the appropriate material for the inner containers.

According to the present invention the fluids in the inner containers can be all those liquids mentioned already but also solid materials which share liquid characteristics for example fine granular materials. Typical examples would include granular detergents and other household cleaners.

The shape of the inner containers should allow the rectangular outer case to be tightly fit round the inner containers. Usually this will require rectangular shaped inner containers like those known as bricks or those having an essentially rectangular shape but with a gable top which can be folded into a flat surface, without resulting in bends, creases or other weakening of the material. The height of the top flap of the gable top above the plane defined by the top edges of the inner container when folded down should be as small as possible, preferably less than 10 mm and most preferably less than 5 mm.

The outer case material is selected from the same materials as the inner container but also could be a pure cardboard or corrugated cardboard material. Preferably some or all of the polymeric and paper or cardboard materials used for the inner container or for the outer case should be made of recycled material.

The outer case has in the final packaging assembly to tightly fit around the inner containers. Tightly fitting as used herein means that there is essentially no empty space between the top of the inner containers and the outer case lid or between the side walls of the inner containers and the adjacent inner container or the outer case side wall. It is particularly preferred that the space between the top of the inner containers and the outer case lid or the sum of all spaces between one side wall and the opposing side wall plus all the spaces between inner containers from one side wall to the other is less than 5 mm, most preferably even less than 3 mm. This tight fitting also prevents or reduces damages resulting from relative movement of inner containers to each other or to the outer case.

The inner containers are not 100% filled with the fluid but comprises a head space filled with gas. Preferably the gas of the head space should be selected from a gas which is inert relative to the fluid in the container. For example for fruit juice beverages, a nitrogen or carbon dioxide gas is preferred over air which however can be easily used for household chemicals.

The head space filled with gas has preferably a volume of 5% to 25%, of the volume of the fluid in the inner container. Having a volume within this range allows for optimal utilization of the container volume while providing enough head space to result in a broadly stable pressure difference relative to ambient pressure at 20° C. by representing a large enough gaseous pressure buffer.

For practical purposes, the relevant ambient pressure is taken at 20° C. when closing the inner container. The increase of the inside pressure of the inner container is selected such that even under temperature and barometric pressure changes, there remains a positive inside pressure difference to provide the desired strength increase and to improve stackability. Practically this is satisfied when the inside pressure is at least 1000 Pa, preferably more than 3000 Pa above the relevant ambient pressure.

A particularly preferred execution of the present invention and the process according to the present invention, will now be explained in reference to the Figures. The packaging assembly (1) consists of the lower tray part (10). The lower tray part (10) is provided as a flat card board blank having a bottom portion (11), side panels (14), front and rear panels (15), the side panels (14) further having attachment flaps (16) and (18).

When making the packaging assembly according to the present invention the inner containers (20) are placed on the bottom part (11) of the flat carton blank. Then the side panels (14) and the front and rear panels (15) are folded up to form the lower tray part (10) by being joined along corresponding vertical edges. In a last step to provide the packaging assembly according to the present invention a lid (12) is placed on top of the lower tray part (10) on top of the inner containers and is then fixed to the two opposite horizontal edges formed by flaps (16). The joining along edges of the outer carton preferably is provided by hot melt adhesives or welding.

Figure 2:
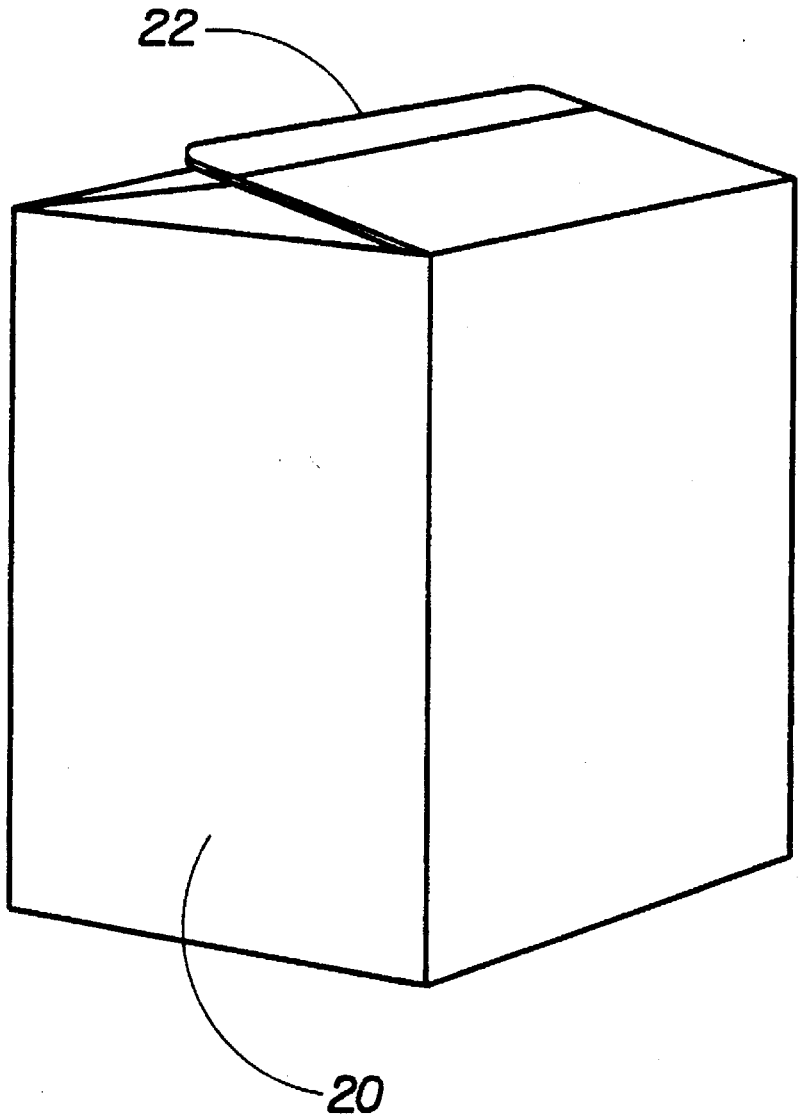
FIG. 2 shows a gable top inner container.

A particularly preferred embodiment of the packaging assembly of the present invention comprises a use of inner containers having a flat foldable gable top shown as number 22 in FIG. 2. Especially when using flat foldable gable top inner containers, the inner container can be filled under ambient pressure leaving a gas filled head space in the gable. When folding the gable into a flat position the pressure inside the inner container increases such that the requirements of the present invention are fulfilled. Packaging assemblies comprising such flat folded gable top inner containers are particularly desirable since upon folding up the gable top by the end user, the inside pressure of the inner container is released within the container itself, avoiding any possible danger of spilling fluid due to the overpressured inner container upon opening.

EXAMPLES

In the following example, the improved stackability of packaging assemblies according to the present invention is demonstrated.

Inner containers having a gable top design similar to that of FIG. 2 which can be folded down to form a flat top are available from Elopak™, Lierstranda, Norway, under the designation Universal Gable Top™. They have a gable top flap height above the plane of the top of the container of about 5 mm before being tightly packed into the outer case. The inner containers are made of a paper or cardboard laminate with polyethylene outer layers and possibly an additional barrier layer. The inner containers are filled with an uncompressable liquid detergent which occupies about 85% of the volume of the inner container. The gas volume of 15% is filled with air.

Eight of these inner containers are packed into an outer case of corrugated cardboard (B-flute or E-flute widely available for example from Seiffert GmbH, Reichenbach, Germany) to form a packaging assembly according to the invention. The measured inside pressure above ambient pressure at 20° C. in the inner containers when they are in the packaging assembly according to the invention was 3000 Pa.

A measurement of the vertical acceptable force applied over the full top surface until permanent deformation occurs was taken with results according to the following table:

| Sample | Force at permanent deformation |
|---|---|
| 1 inner container* | 200N |
| 8 inner containers* together | 1200N |
| 1 outer case* | 1000N |
| packaging assembly of the example** | 3000N |

*as described in the example
**according to the invention

The theoretically expected additive acceptable force just before permanent deformation which could be expected is 2200 N. Therefore the packaging assembly according to the invention provides an additional 800 N which can be used to increase the number of such packaging assemblies when stacking them on top of each other by 36%.

What is claimed is:

1. A packaging assembly of multiple identical flexible inner containers for fluids combined in a tight fitting outer case of rectangular shape suitable for vertical stacking of said packaging assembly, said flexible inner containers comprising a gaseous head space above said liquid, said packaging assembly being characterized in that said flexible inner containers have an inside pressure above the relevant ambient pressure at 20° C. and said gaseous head space is from 5% to 25% of the volume of said liquid in said inner containers.

2. A packaging assembly of multiple identical flexible inner containers for fluids combined in a tight fitting outer case of rectangular shape suitable for vertical stacking of said packaging assembly, said flexible inner containers comprising a gaseous head space above said liquid, said packaging assembly being characterized in that said flexible inner containers have an inside pressure above the relevant ambient pressure at 20° C. and said gaseous head space is filled with a gas which is inert relative to said fluid in said inner containers.

3. A packaging assembly multiple identical flexible inner containers for fluids combined in a tight fitting outer case of rectangular shape suitable for vertical stacking of said packaging assembly, said flexible inner containers comprising a gaseous head space above said liquid, said packaging assembly being characterized in that said flexible inner containers have an inside pressure above the relevant ambient pressure at 20° C., said inner containers are rectangular and have essentially flat foldable gable tops, and said inner containers have an essentially flat foldable gable top and said inside pressure is less than 100 Pa above the relevant ambient pressure at 20° C. when said flat foldable gable top is in an upright gable top position.

* * * * *